US005730352A

United States Patent [19]

Deekes

[11] Patent Number: 5,730,352

[45] Date of Patent: Mar. 24, 1998

[54] FLAT PACK CONTAINER

[75] Inventor: Michael Deekes, Sandridge, United Kingdom

[73] Assignee: Associated Marketing Direction, United Kingdom

[21] Appl. No.: 681,942

[22] Filed: Jul. 29, 1996

[30] Foreign Application Priority Data

Feb. 15, 1995 [GB] United Kingdom ..... 9502904

[51] Int. Cl.[6] ..... B65D 3/00

[52] U.S. Cl. ..... 229/4.5; 229/125.17; 220/786; 220/788; 220/916

[58] Field of Search ..... 229/4.5, 125.17, 229/125.18; 220/916, 780, 784, 786, 788

[56] References Cited

U.S. PATENT DOCUMENTS

| | | | |
|---|---|---|---|
| 979,261 | 12/1910 | Compton | 229/125.28 X |
| 1,344,601 | 6/1920 | Walgren | 229/125.28 X |
| 3,913,774 | 10/1975 | Vajtay | 220/315 X |
| 3,986,659 | 10/1976 | Vijtay . | |
| 4,215,779 | 8/1980 | Vitjtay . | |
| 5,372,269 | 12/1994 | Sutton et al. | 229/125.28 X |

FOREIGN PATENT DOCUMENTS 0059314 1/1982 European Pat. Off. .

*Primary Examiner*—Stephen Cronin
*Attorney, Agent, or Firm*—Hayes, Soloway, Hennessey, Grossman & Hage, P.C.

[57] ABSTRACT

The container includes a sheet rolled or folded into a tube of a required cross-section and a bottom cap and top cap for the tube ends, each end cap defining an endless groove corresponding to the tube cross-section. At least one wall defining the groove of at least one of the end caps has projections at spaced locations, each shaped to provide a lead-in face and a rear retaining face. The sheet is provided with appropriately shaped apertures at spaced locations corresponding to the projections adjacent one end edge thereof, the arrangement being such that, in fitting the end cap to its adjacent tube end, the apertures of the tube end are guided by the lead-in and opposed faces of the end cap, to locate over and be positively retained by the retaining faces of their corresponding projections. Preferably, the top end cap defines an opening for the container and is also provided with an endless groove having similar projections and opposed faces, the top edge of the sheet being provided with corresponding apertures.

8 Claims, 2 Drawing Sheets

FLAT PACK CONTAINER

BACKGROUND OF THE INVENTION

1. Field of the Invention

This invention relates to flat-pack containers of the kind comprising a flat rectangular sheet of e.g. cardboard, plastics, or metal film, which can be rolled or folded into a length of tube and assembled into a container by fitting end caps. Thus, simply by rolling or folding, as appropriate, a container of circular, or rectangular, cross-section can be formed simply by fitting bottom and top caps to its ends, each cap defining a groove of appropriate shape, into which the adjacent edge of the tube length is located.

Such containers are normally used as pots for lightweight contents, e.g. for containing pens, pencils etc, and also as wastepaper baskets.

2. Brief Description of Related Prior Art

A particular problem with such containers is that the end caps are not fixedly located in the grooves of their respective end caps. An arrangement is known in which protrusions are formed at spaced positions around the groove wall which tend to press against the tube edge when fitted. However, since the fit of the end caps relies on friction, this does not produce positive locking, with the result that the container cannot be used for contents of any significant weight.

The object of this invention is to provide a flat-pack container of the kind discussed above which provides positive locking for at least the bottom end cap.

SUMMARY OF THE INVENTION

According to this invention a flat-pack container comprises a sheet of suitable material to be rolled or folded into a tube length of a required cross-section and top and bottom caps for the ends of the tube, each end cap defining an endless groove corresponding to the cross-section into which the adjacent end edge of the tube is to fit, wherein one of the groove walls of the bottom end cap is provided at spaced locations with a projection which is shaped to provide a chamfered lead-in face and a rear retaining face, wherein the other groove wall is angled towards said retaining face, and wherein the sheet is provided with appropriately shaped apertures at spaced locations corresponding to the projections adjacent its bottom end edge, whereby, for fitting, the tube end and bottom end cap are aligned with respective projections and apertures in registration and pushed together, thereby causing portions of the tube edge adjacent the projections to be guided by the lead-in and the angled face of the projections to locate the apertures over their respective projections and be retained by said retaining faces.

Preferably, the top end cap is also provided with similar projections and the top edge of the sheet is provided with corresponding apertures.

BRIEF DESCRIPTION OF THE DRAWINGS

In order that this invention may be readily understood, one embodiment will now be described with reference to the accompanying drawings, in which.

DETAILED DESCRIPTION OF PREFERRED EMBODIMENTS

Figure 1:
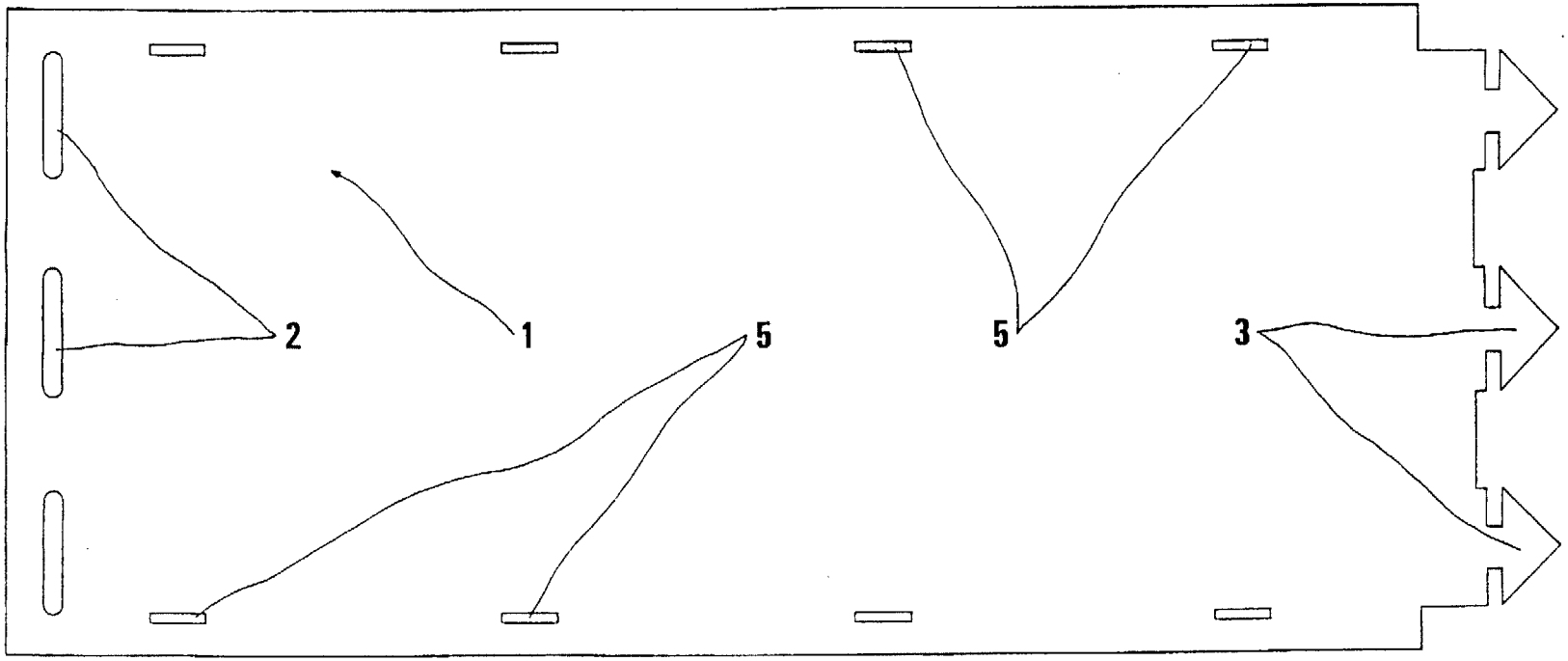
FIG. 1 is a view of the container sheet

Referring to FIG. 1 of the drawings, the container sheet 1, which is preferably of plastics such as polypropylene, is rectangular, with a series of three apertures 2 at one end, and a corresponding series of three shaped tabs 3 at the other end, for retaining the sheet in the form of a tube 4 (see FIG. 2) after rolling or folding. The two longitudinal edges of the sheet 1 have a series of spaced apertures 5.

Figure 2:
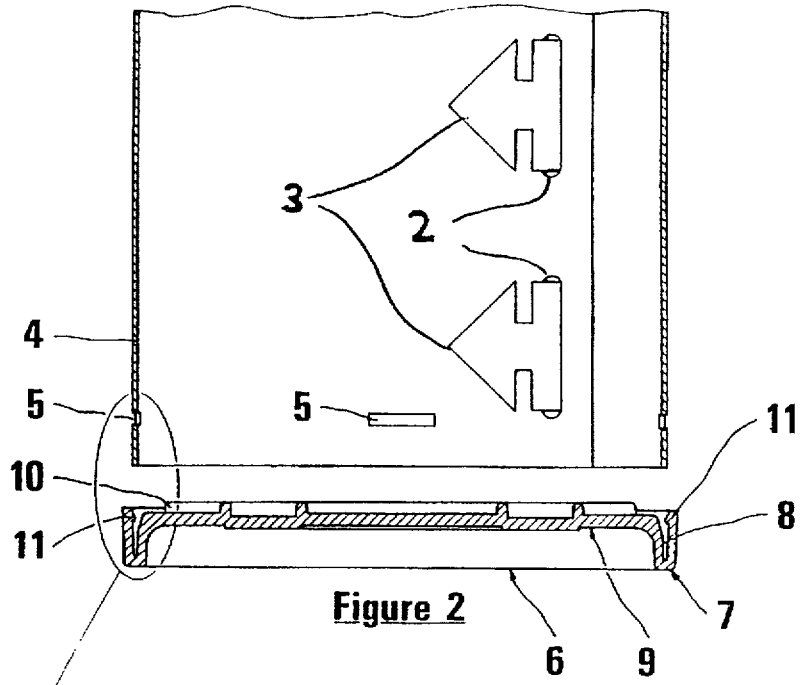
FIG. 2 is an exploded, fragmentary, half-section of the tube formed from the sheet and the bottom end cap.
Figure 3:
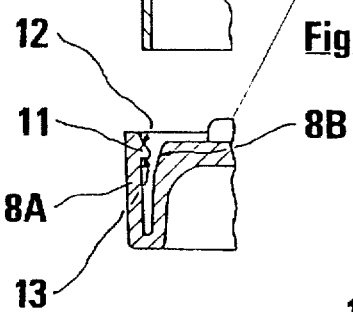
FIG. 3 is a plan view of the bottom end cap.
Figure 3:
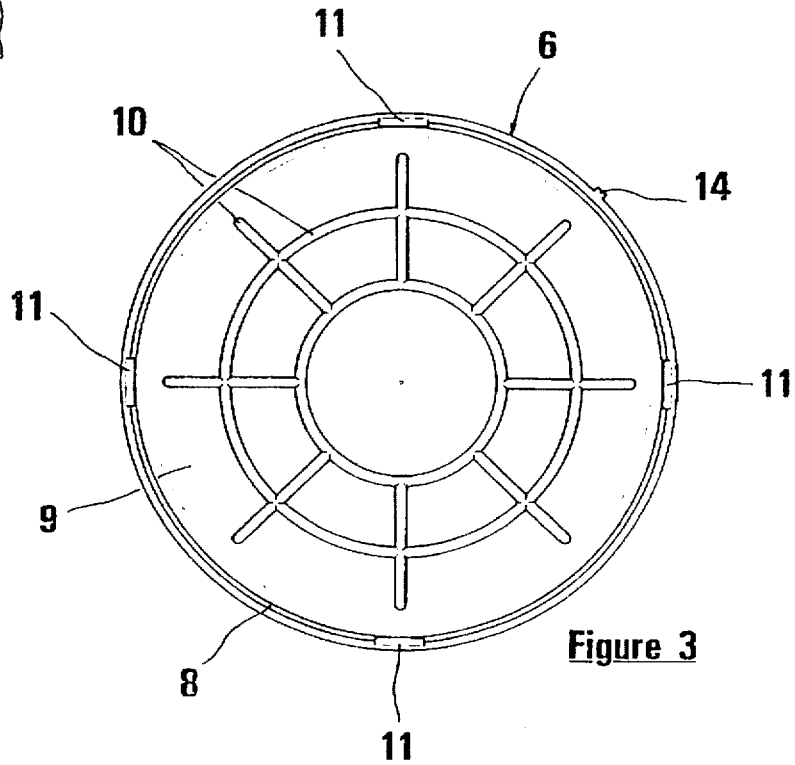

Referring to FIGS. 2 and 3, the bottom end cap 6 is circular in this embodiment and has a peripheral wall 7 in which is defined an endless, circular groove 8 corresponding to the circular cross-section of the tube 4.

The cap in this embodiment is also preferably of plastics, such as PVC, and the end wall 9 thereof is suitably strengthened to resist significant loading, in the embodiment by ribs 10.

Figure 2A:
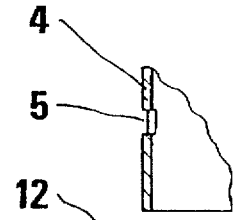
FIG. 2A is an enlarged detail of FIG. 2.

At spaced locations around the groove 8, corresponding to the spacing at the aperture 5, one groove wall 8A (see FIG. 2A) is provided with projections each being shaped to provide a chamfered lead-in 12 and a rear retaining face 13, and the other groove wall 8B is angled towards the projection, as shown. Thus, for fitting, the tube 4 is aligned with the bottom end cap 6 with its apertures 5 in registration with the projections, which operation can be facilitated by a registration mark or projection 14 on the wall 7 of the bottom cap 6 (see FIG. 3). For assembly, the two components are pushed together, whereby the lead-in chamfers 12 of projections 11 cause adjacent portions of the tube end to be pushed inwardly, and thereafter outwardly by the angle of the groove wall 8B, and hence cause respective apertures 5 to ride over and be positively retained by the retaining faces 13.

It will be appreciated that the top end cap (not shown), in the form of an annular ring, would be similarly provided with spaced projections for the apertures 5 at the top end of the tube 4.

It will be appreciated that, due to the provision of the positive fixing, the flat-pack container, when assembled, has a far wider range of uses than heretofore. Also, by suitable choice of materials, it can be used to contain significant weights and be weatherproof, e.g. for use as a flower pots and shrub containers.

I claim:

1. A flat-pack container comprising a flexible sheet which may be rolled and folded to form a tube, and top and bottom caps for capping the ends of the tube, each end cap having opposed walls defining an endless groove into which an adjacent end edge of the tube may be fitted, wherein one of the opposed walls of at least one of the end caps is provided at spaced locations with projections which are shaped to provide a lead-in face and a rear retaining face, wherein the other opposed wall of said at least one end cap has, at least at said spaced locations, an opposed face directed towards said retaining face, and wherein the sheet is provided with apertures at spaced locations corresponding to the spacing of the said projections on the said one opposed wall, wherein on fitting the at least one end cap to its adjacent tube end, the apertures of said tube end are guided by said lead-in and opposed faces of the bottom end cap, to locate over and be positively retained by the retaining faces of their corresponding projections, and said at least one end cap is provided with at least one registration mark for aligning the projections on the at least one end cap with the corresponding apertures of the tube.

2. A flat-pack container according to claim 1, wherein the top end cap has an annular form defining an opening for the container and is also provided with an endless groove having similar projections and opposed faces and the top edge of the sheet is provided with respective corresponding apertures.

3. A flat-pack container according to claim 1, wherein the bottom end cap has an end wall which is strengthened to resist loading.

4. A flat-pack container according to claim 1, wherein said sheet is rectangular, and has a series of spaced apertures at one end, and a corresponding series of spaced, shaped tabs at another end, for retaining the sheet, upon rolling, in the form of a tube.

5. A flat-pack container according to claim 1, wherein the sheet is made of plastic material.

6. A flat-pack container according to claim 5, wherein said plastic material is polypropylene.

7. A flat-pack container according to claim 1, wherein at least one of the end caps is made of plastic.

8. A flat-pack container according to claim 7, wherein said plastic is PVC.

* * * * *